US006082261A

United States Patent [19]

Richards

[11] Patent Number: 6,082,261

[45] Date of Patent: Jul. 4, 2000

[54] NARROW-GAP PLATE CYLINDER WITH PLATES ATTACHED TO PARTIALLY CYLINDRICAL SHELLS

[75] Inventor: John S. Richards, Barrington, N.H.

[73] Assignee: Heidelberger Druckmaschinen AG, Heidelberg, Germany

[21] Appl. No.: 09/266,094

[22] Filed: Mar. 10, 1999

[51] Int. Cl.[7] ..... B41F 27/06

[52] U.S. Cl. ..... 101/378; 101/374; 101/385

[58] Field of Search ..... 101/374, 375, 101/378, 385, 386, 415.1, 382.1, 383

[56] References Cited

U.S. PATENT DOCUMENTS

| | | | |
|---|---|---|---|
| 602,381 | 4/1898 | White et al. | 101/385 |
| 655,802 | 8/1900 | Russell | 101/378 |
| 885,747 | 4/1908 | Green | 101/378 |
| 1,377,506 | 5/1921 | Novotny | 101/378 |
| 1,648,598 | 11/1927 | Smith | 101/378 |
| 1,763,124 | 6/1930 | Barber | 101/375 |
| 3,745,921 | 7/1973 | MacDonald et al. | 101/378 |
| 3,941,055 | 3/1976 | Semmler et al. | 101/378 |
| 3,970,001 | 7/1976 | Mollon et al. | 101/378 |
| 4,143,597 | 3/1979 | Kesten et al. | 101/378 |

*Primary Examiner*—John S. Hilten
*Assistant Examiner*—Leslie J. Grohusky
*Attorney, Agent, or Firm*—Kenyon & Kenyon

[57] ABSTRACT

A plate cylinder including a plate cylinder body; a first partially cylindrical image carrying shell and a second partially cylindrical image carrying shell, the shells being removably fastened to the plate cylinder body. Printing plates can be prefastened to the shells. The present invention also provides a method for attachment to a printing cylinder including the steps of mounting a first partially cylindrical shell and a second partially cylindrical shell to a printing cylinder body.

6 Claims, 3 Drawing Sheets

NARROW-GAP PLATE CYLINDER WITH PLATES ATTACHED TO PARTIALLY CYLINDRICAL SHELLS

FIELD OF THE INVENTION

The present invention relates generally to printing presses and more particularly to an apparatus and method for attaching a printing plate or image carrier to a plate cylinder.

BACKGROUND INFORMATION

Printing presses, including offset lithographic web printing presses, often utilize printing plates placed on a plate cylinder of a press to provide an image carrier. Ink is then applied to the image carrier so that the image eventually is transferred to a web or sheet of material, such as paper.

An offset lithographic web printing press typically includes a plate cylinder, a blanket cylinder and an impression cylinder supported for rotation in the press. A single printing plate having a surface defining an image is secured to the plate cylinder. Ink is applied to the image-carrying surface of the printing plate. A printing blanket having a transfer surface lies on the blanket cylinder. The printing blanket surface contacts the printing plate at a nip between the plate cylinder and the blanket cylinder. The printing plate surface transfers the image to the printing blanket surface at the nip and the printing blanket surface then transfers the image to a web of material, such as paper.

The printing plate typically is a flat rectangular sheet of material and is mounted on a plate cylinder by wrapping the plate around the plate cylinder and inserting the ends of the plate into an axially-extending gap in the plate cylinder. However, the gap in the plate cylinder between the ends of the plate can create undesirable vibrations and an undesired non-printing area.

Other offset printing presses use tubular and continuous printing forms to eliminate the gap on the plate cylinder. These presses however require complicated axial removability through the frame and a complicated construction for securing the tubular printing form on the plate cylinder, such as an air cushion release system.

SUMMARY OF THE INVENTION

The present invention provides a plate cylinder comprising: a plate cylinder body; a first partially cylindrical shell and a second partially cylindrical shell, the first and second shells being removably fastened to the plate cylinder body. A first printing plate can be prefastened to the first shell and a second printing plate can be prefastened to the second shell. The first shell has a first shell first end which can abut with a second shell first end of the second shell, so that a very small gap can be achieved between the shells or the plates on the shells.

The present invention also provides a method for attachment to a plate on a plate cylinder comprising the steps of: mounting a first partially cylindrical shell having a first shell first end to a plate cylinder body; and mounting a second partially cylindrical shell having a second shell first end to the plate cylinder body. The method also may include fastening a first printing plate to the first shell and fastening a second printing plate to the second shell. The first shell first end and second shell first end can abut so as to provide a very small gap between the shells or the plates.

Thus through the use of the shells in the present invention, the size of the gaps in the plate cylinder can be made extremely small or non-existent.

One embodiment of the present invention involves first and second printing plates. Each plate may have two ends which can be bent inward. The plate can be mounted in notches in the shell. However, the plate could also be glued or mounted magnetically to the shell, for example.

With a bent plate, the plate may be mounted on the shell subsequent to being bent or the plate can be bent while on the shell. Because of this, the plate mounting and unmounting times may be minimized and done without disturbing other plates of the plate cylinder. The plate may be mounted on the shell via motors or other mechanisms. Once the plate is mounted, the plate and the shell combination may be mounted on the plate cylinder body via motors or other mechanisms. The other mechanisms may include manual mounting, an assembly of mechanical levers and the like operated manually or via motors, automatic motorized levers, etc. Advantageously, the plates and shell can be unmounted and mounted on the plate cylinder body without susceptibility of damage to thin plates or their bent edges.

In the present invention, automatic mounting of the plate and shell combination advantageously can be simple linear motions. A position of the shell thus can be adjusted individually laterally and angularly on the cylinder body to ensure proper registration and fanout. Varying shell thicknesses and plate lengths can provide varied cutoff image lengths to the printing blanket.

With the present invention, the plate may be mounted on the shell such that the ends of the plate are bent inward towards the shell. With two or more shells, having previously mounted plates, mounted on a cylinder body, the meeting of the edges of any two shells provides an extremely narrow gap. The gap is narrow due to the effective close fit of the plate to the shell. Thus, in the present invention, the printing area can effectively exhibit a narrow non-print gap.

Another embodiment of the present invention includes providing an image directly on the shells, so that no plates are required. This can be performed by gravure or laser-based processes, for example.

The shells can be fastened in various ways to the plate cylinder body. Preferably, however, the shell has a mount which allows the shell to be locked in place to the plate cylinder body. Each plate and shell combination can be put on and taken off the printing press as a single unit. After use, the shell can be removed and the used printing plate can be removed from the shell to allow the shell to be reused with other printing plates.

In the present invention, the use of the shell and the plate can be for general use in many applications including, but not limited to, an offset printing press, a gapless blanket, a tower style printing press, as multiple plates on a shell, various page-width shells, with a straight stack, with pin registers, with variable cut-off parts, and with varied sized cylinders having various shell thicknesses.

The plate and shell combination may involve motorized adjustment and positioning of the plate on the plate cylinder body. The plate may also be adjusted positionally via closed loop detection from printed marks or via plate marks detected after the plate is mounted on the shell.

BRIEF DESCRIPTION OF THE DRAWINGS

In the following description, the present invention is explained in more detail with the aid of drawings, in which.

DETAILED DESCRIPTION

Figure 1:
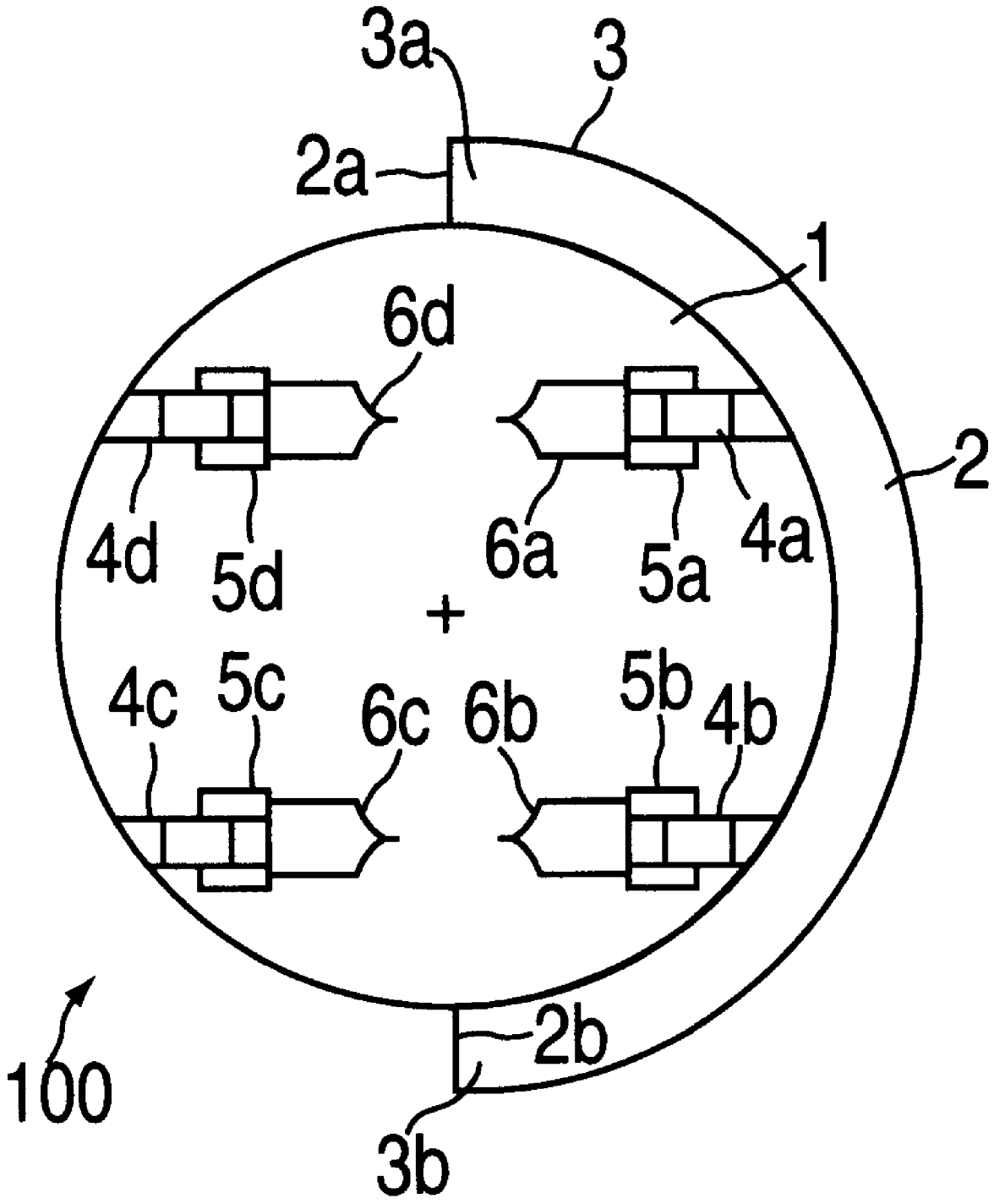
FIG. 1 shows a plate and a shell mounted on a cylinder of the present invention.

FIG. 1 shows a plate cylinder 100 partially assembled having a plate cylinder body 1 and having a shell 2 having ends 2*a,* 2*b.* The shell 2 has a previously mounted plate 3 having ends 3*a,* 3*b* fitting into slots in the shell for fastening. Shell 2 is connected to plate cylinder body 1 by threaded bolts 4*a* and 4*b* on shell 3 and interface locking nuts 5*a* and 5*b* which can be rotated by rotating drivers 6*a* and 6*b* in plate cylinder body 1 so as to lock the shell 2 to the plate cylinder body 1. The shell 2 and the plate 3 can be unmounted and removed together by reversing the mounting steps.

Figure 2:
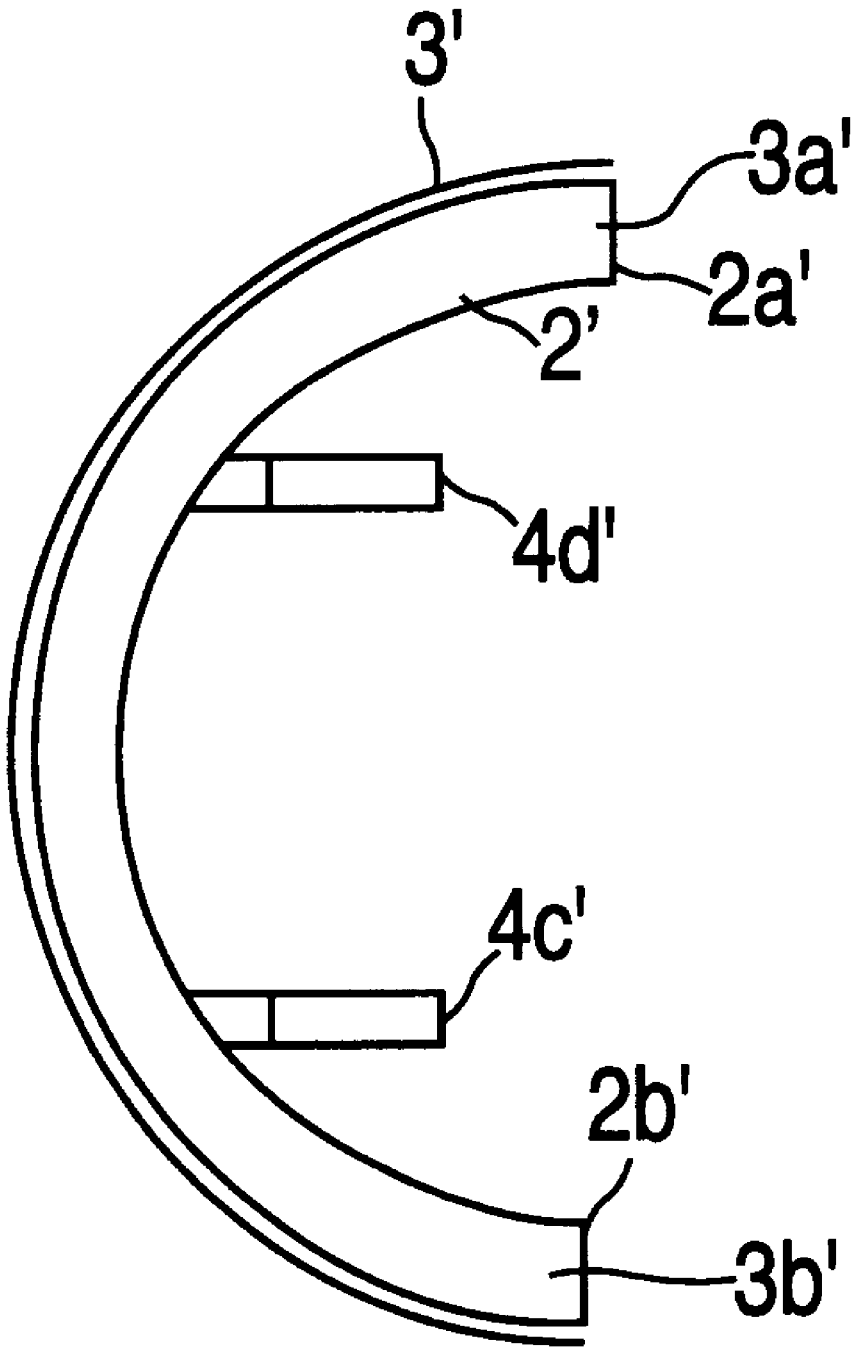
FIG. 2 shows a plate mounted on a shell of the present invention.

To attach a second shell 2', shown in FIG. 2, the plate cylinder 100 has threaded bolts 4*c,* 4*d,* locking nuts 5*c,* 5*d,* and rotating drivers 6*c* and 6*d,* which operate to lock second shell 2' to the plate cylinder body 1 in a similar fashion as described above with respect to shell 2.

FIG. 2 shows plate 3' having bent ends 3*a'*, 3*b'* is mounted on shell 2' having ends 2*a'*, 2*b'*. The threaded bolts 4*c'*, 4*d'* are shown connected to the shell for use in locking the shell with the previously mounted plate to a cylinder.

Figure 3:
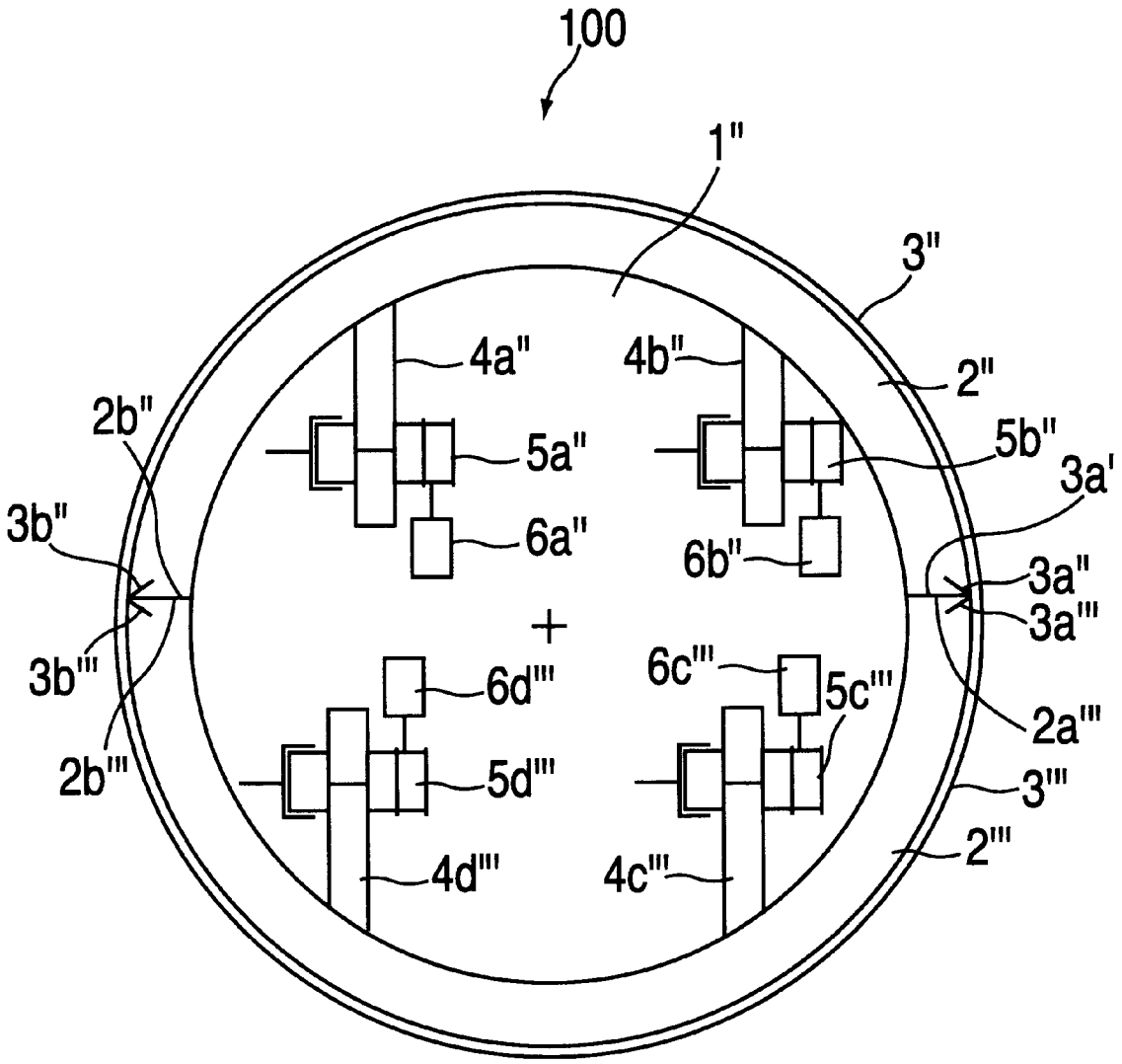
FIG. 3 shows another embodiment of the present invention.

FIG. 3 shows plate cylinder 100 having plate cylinder body 1" and two partly cylindrical shells 2", 2'" having ends 2*a"*, 2*b"* and 2*a'"*, 2*b'"*, respectively, with previously mounted plates 3", 3'" having bent ends 3*a"*, 3*b"* and 3*a'"*, 3*b'"*, respectively. The shells 2", 2'" are shown mounted on the plate cylinder body 1" in locked position. The shells 2", 2'" having attached threaded bolts 4*a"*, 4*b"*, 4*c'"*, 4*d'"* and previously mounted plates 3", 3'" are locked onto the plate cylinder body 1" by the interfacing of the threaded bolts 4*a"*, 4*b"*, 4*c'"*, 4*d'"* with the rotatable threaded nuts 5*a"*, 5*b"*, 5*c'"*, 5*d'"*, respectively. The rotatable threaded nuts 5*a"*, 5*b"*, 5*c'"*, 5*d'"*are rotated onto the threaded bolts 4*a"*, 4*b"*, 4*c'"*, 4*d'"*, respectively, by rotating devices 6*a"*, 6*b"*, 6*c'"*, 6*d'"*, respectively. These can be simple motors.

"Partially cylindrical shell" as used herein means that an outer surface of the shell is partially cylindrical. While preferable, the inner surface need not be cylindrical and could be V-shaped or have other surface configurations to interact with a correspondingly-shaped cylinder body.

What is claimed is:

1. A plate cylinder comprising:

a plate cylinder body having a plurality of threaded nuts;

a first partially cylindrical shell carrying an image and being removably fastened to the plate cylinder body, the first partially cylindrical shell having a plurality of bolts for contacting the plurality of threaded nuts;

a motorized adjuster rotating the nuts with respect to the belts for adjusting a position of the first partially cylindrical shell on the plate cylinder body; and a second partially cylindrical shell carrying another image and being removably fastened to the plate cylinder body.

2. The plate cylinder as recited in claim 1 further comprising a first image-carrying plate attached to the first partially cylindrical shell.

3. The plate cylinder as recited in claim 1 wherein the image is formed directly on the first partially cylindrical shell.

4. The plate cylinder as recited in claim 1 wherein the first partially cylindrical shell has a mount for mounting to the plate cylinder body.

5. The plate cylinder as recited in claim 1 further comprising a first printing plate attached to the first partially cylindrical shell and a second printing plate attached to the second partially cylindrical shell.

6. The plate cylinder as recited in claim 2 wherein the first plate has a first plate end and a second plate end, the first plate end being bent to fit about a first shell end of the first partially cylindrical shell and the second plate end being bent to fit about a second shell end of the first partially cylindrical shell.

* * * * *